United States Patent [19]

Jolidon et al.

[11] Patent Number: 4,944,170

[45] Date of Patent: Jul. 31, 1990

[54] DEVICE FOR LIFTING A TIME BAN ON THE ACTUATION OF A MECHANISM IN A CONDITIONAL-OPENING LOCKING SYSTEM IN THE EVENT OF A BREAKDOWN

[75] Inventors: Francois Jolidon, La Chaux-de-Fonds; Willy Richard, Les Convers 5, both of Switzerland

[73] Assignee: Relhor S.A., La Chaux-de-Fonds, Switzerland

[21] Appl. No.: 87,057

[22] Filed: Aug. 19, 1987

[30] Foreign Application Priority Data

Aug. 20, 1986 [FR] France ..... 86 11974

[51] Int. Cl.[5] ..... E05B 43/00

[52] U.S. Cl. ..... 70/267; 70/271; 70/274

[58] Field of Search ..... 361/189; 200/19 L; 70/267-274, 465

[56] References Cited

U.S. PATENT DOCUMENTS

| | | | |
|---|---|---|---|
| 197,826 | 12/1877 | Chinnock | 70/271 |
| 2,073,523 | 3/1937 | Meilink | 70/272 |
| 2,191,694 | 2/1940 | Hirn | 70/274 |
| 3,065,612 | 11/1962 | Coss | 70/272 |
| 3,576,119 | 4/1971 | Harris | 70/271 |
| 3,881,171 | 4/1975 | Moorman et al. | 340/825.32 |
| 3,950,678 | 4/1976 | Brewer | 70/271 X |
| 4,038,846 | 8/1977 | Klann | 70/220 |
| 4,634,846 | 1/1987 | Harvey et al. | 340/825.31 X |
| 4,774,512 | 9/1988 | Jolidon et al. | 340/825.31 |

FOREIGN PATENT DOCUMENTS

| | | | |
|---|---|---|---|
| 0000744 | 2/1979 | European Pat. Off. . | |
| 0102346 | 3/1984 | European Pat. Off. . | |
| 0125813 | 11/1984 | European Pat. Off. . | |
| 0197893 | 10/1986 | European Pat. Off. . | |
| 2252986 | 5/1974 | Fed. Rep. of Germany | 70/269 |
| 2080399 | 2/1982 | United Kingdom | 70/267 |

*Primary Examiner*—Lloyd A. Gall

*Attorney, Agent, or Firm*—Sughrue, Mion, Zinn, Macpeak & Seas

[57] ABSTRACT

The mechanism comprises a bar (8) slidably mounted in a channel (18) which can be obstructed by a sliding member (11) of an electromechanical latching unit in accordance with a preset time-schedule.

The device described enables the time ban to be lifted by means of two pivotal elements (43, 52) that are normally not coupled to one another, one of them being positionable in the path of travel of the bar (8) of the mechanism so as to be actuated thereby when the mechanism is moved in an opening direction. The two pivotal elements are associated with transmission means (50, 57) which are actuated when a breakdown is detected in order to lock the two pivotal elements together. The electromechanical latching unit can then be made inoperative manually by actuating the mechanism of the locking system in an opening direction.

8 Claims, 8 Drawing Sheets

DEVICE FOR LIFTING A TIME BAN ON THE ACTUATION OF A MECHANISM IN A CONDITIONAL-OPENING LOCKING SYSTEM IN THE EVENT OF A BREAKDOWN

BACKGROUND OF THE INVENTION

1. Field of the Invention

This invention relates to high security locks, as used for instance to close protected enclosures such as bank safes and strongrooms.

2. Description of the Prior Art

To improve the security of protected enclosures, of their contents, and of their operating personnel, it is known to provide locking systems involving a code or a high security key with so-called time-lock devices which will only allow these locking systems to be operated during pre-programmed periods of time, even if the operator possesses the code or the key.

For instance, European Patent Application No. 86810154.8 filed on 8 Mar. 1986 discloses a conditional-opening lock governed by a weekly program that is preferably stored in the memory of a microprocessor. This program provides time-slots during which restrictions imposed on the opening of a door are lifted. To that end, the locking mechanism may be blocked or released by means of an electromagnetically controlled latching unit governed by the microprocessor. By blocking the operation of the locking mechanism, the latching unit imposes an opening ban which can be lifted only if the microprocessor finds that the actual time coincides with a time slot of the preset program.

The electronic and electromagnetic aspects of the locking system are designed to reduce the likelihood of a breakdown or failure to a minimum, since a breakdown or failure may have most unfortunate consequences. For obvious reasons, the lock unit is mounted on the inside of the enclosure's door. This means, however, that should a breakdown occur while the latching unit is blocking the locking mechanism it will no longer be possible to open the door. To get to the contents of the enclosure it then becomes necessary to breach the enclosure by "violent" means which may partly destroy it. This is an extremely costly and hazardous operation and possibly too risky since the contents of the enclosure are, at least for a while, left unprotected.

SUMMARY OF THE INVENTION

An object of the invention is to achieve a coded conditional-release locking system which does not suffer from this drawback.

To this end, the invention provides, in or for use in a coded and conditional-opening locking system having a locking mechanism, an electromagnetic latching unit for blocking the locking mechanism and electronic control means able to activate and de-activate the electromagnetic latching unit according to a time-schedule thereby to enable or disable actuation of the locking mechanism during preset times, a device for lifting, in the event of a breakdown in the system, a time ban on the actuation of the locking mechanism and which comprises detection means able to sense a breakdown in said system and transmission means controlled by the detection means to make, in response to the detection of a breakdown, said locking mechanism mechanically drive said electromagnetic latching unit such that actuation of said locking mechanism will render said electromagnetic latching unit inoperative regardless of its operative state at the time of detecting the breakdown.

Thus, with a device as set forth above, a ban on opening that is affected by a breakdown can be completely lifted, while the release can, when appropriate, be done manually by actuating the locking mechanism itself. However, the opening of the door of the protected enclosure still requires knowledge of the lock's code or possession of its key thereby safeguarding the enclosure's contents although accessible to authorized personnel. The latter however being aware of the malfunction, can have it put right without delay and without having to destroy part of the enclosure's walls or door.

BRIEF DESCRIPTION OF THE DRAWINGS

In the accompanying drawings, given by way of example.

Figure 4:
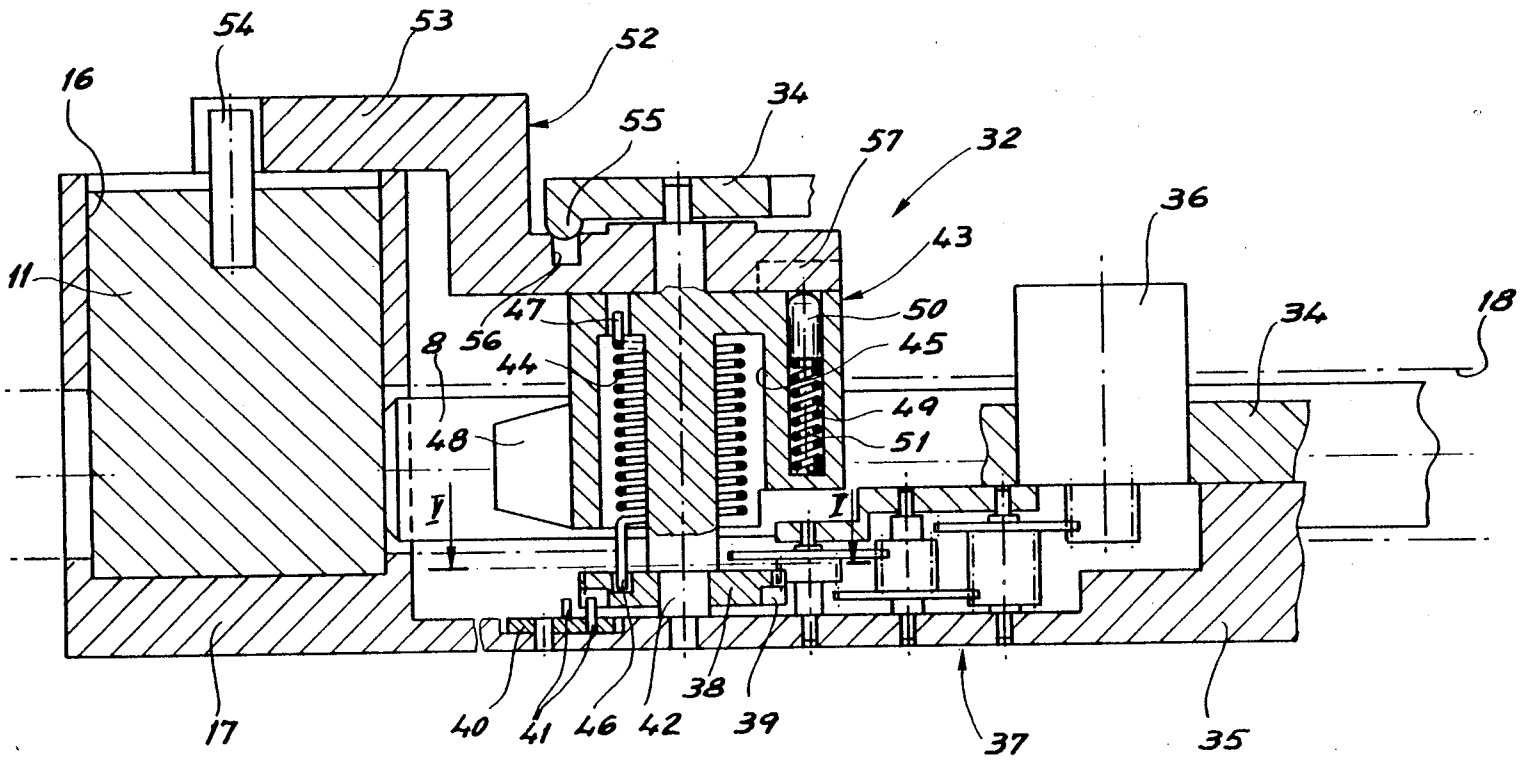
FIG. 4 is a section along line IV—IV of FIG. 3.
Figure 8:
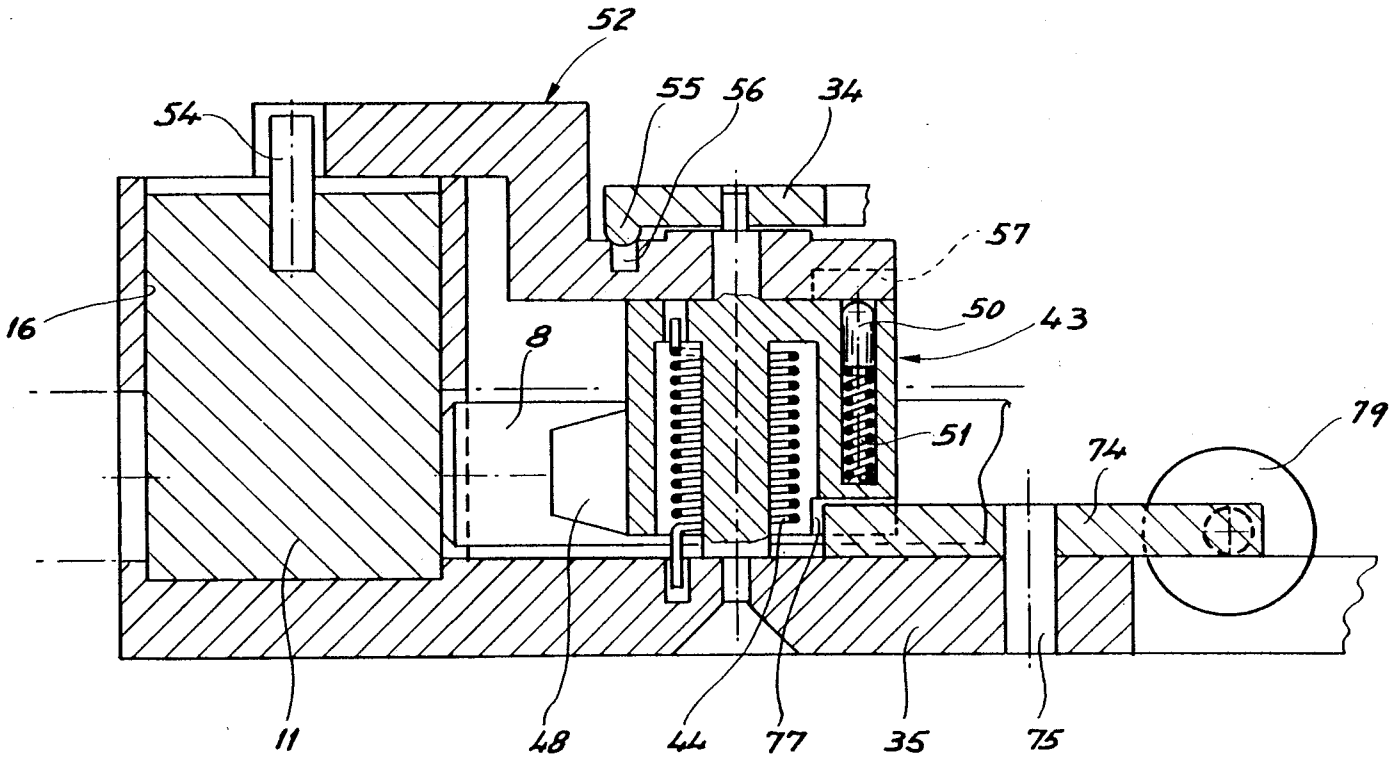
Figure 9:
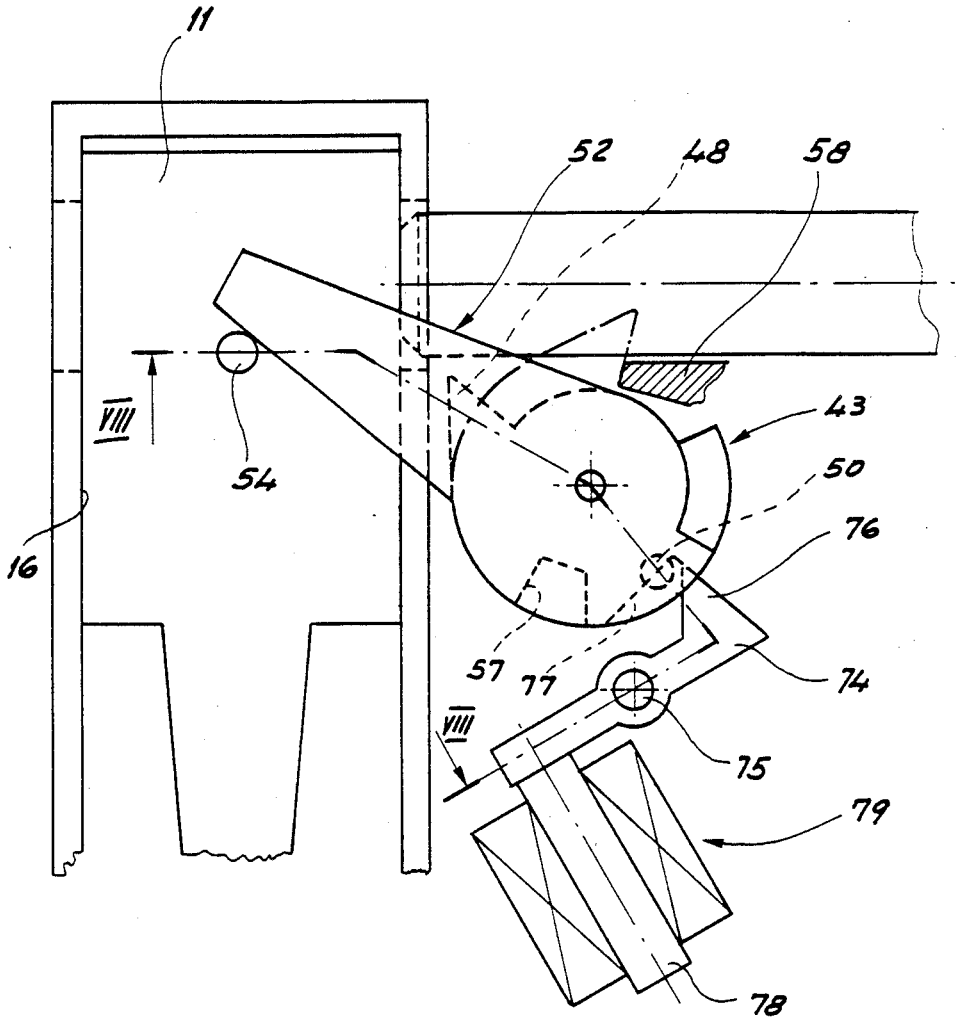

FIGS. *7a* to *7f* are simplified illustrations of several possible operational arrangements of the emergency unlatching device;

FIG. 8 is a view similar to that of FIG. 4 showing a modified form of emergency unlatching device; and FIG. 9 is an elevational view of this modified form of device.

DETAILED DESCRIPTION OF THE PREFERRED EMBODIMENTS

Figure 1:
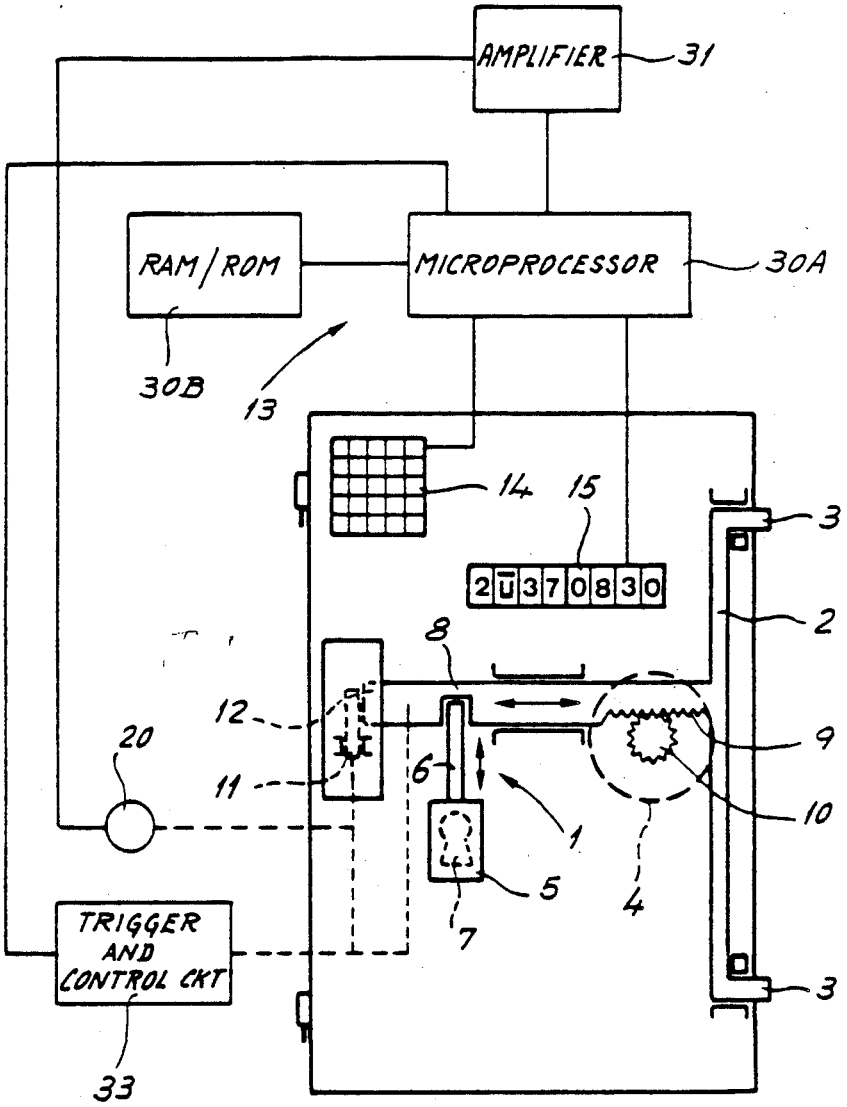
FIG. 1 is a general diagram of a locking system provided with a manual unlatching emergency device, according to the invention.

The locking system shown in FIG. 1 is illustrated in conjunction with the inner surface of a door of a protected enclosure, such as a safe, a bank, strongroom or the like. The locking system for the enclosure being conventional, no detailed description thereof will be needed. Suffice it to say that the locking system, referenced 1, comprises a rod assembly 2, bearing latch bolts 3, which can be moved from a latching position to an unlatched position, and vice versa, by means of a handwheel 4. A lock 5 housed in a casing and having a bolt 6 may be actuated with a conventional key through a keyhole 7. Lock 5 may of course be provided with coding means other than a key, as complex as desired depending on the degree of security required for the contents of the safe.

Bolt 6 cooperates with a bar 8 of rod assembly 2, the bar being mounted for horizontal sliding motion and comprising a rack 9 which cooperates with a pinion 10 mounted on hand wheel 4.

Rod assembly 2 cannot be actuated by hand wheel 4 when lock 5 is closed, i.e. with bolt 6 in a raised position as shown.

As described in European Patent Application No. 86810154.8, mentioned earlier, actuation of rod assembly 2 can also be prevented by a blocking device 11. Thus, to open the safe, both device 11 must be released and lock 5 must be opened.

Although shown only summarily in FIG. 1, blocking device 11 is designed to move vertically and to prevent rod assembly 2 from sliding in an opening direction by projecting into the path of bar 8 near the rear end 12 of the latter. Blocking device 11 is power driven and controlled by an electronic circuit 13 to which are connected a control keyboard 14 and display means 15. Keyboard 14 is provided on the inside of the door, whereas display means 15 has two display panels on opposite sides of the door.

Figure 2:
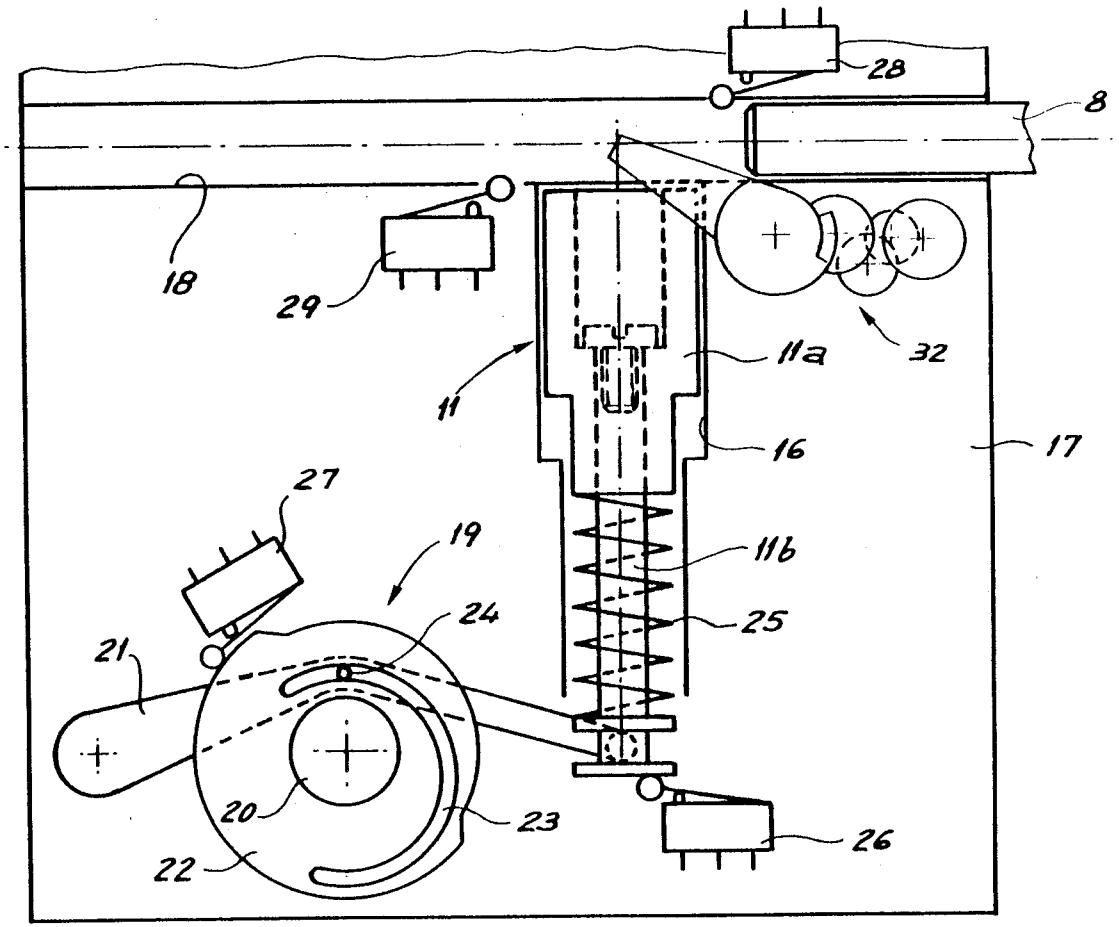
FIG. 2 is a larger-scale diagram showing details of the locking system that are important for an understanding of the invention.

As shown in FIG. 2, blocking device 11 comprises a sliding member mounted for axial motion in a guide 16 provided by a support 17 fitted to the door of the safe. The sliding member is made up of two parts that are telescopically mounted with respect to each other, i.e. a blocking element 11*a* and a push-rod 11*b*. Support 17 further provides a passage 18 in which the bar 8 of rod assembly 2 may slide, and into which guide 16 opens in a manner such that sliding member 11, when emerging from guide 16 into passage 18, may prevent bar 8 from moving back.

This motion of sliding member 11 is controlled by a motor unit 19 comprising a motor 20, a lever 21 pivotally mounted on support 17 and a cam 22 mounted on the drive shaft of motor 20 and provided with an eccentric guide groove 23 having the shape of a circular arc. A pin 24, mounted on lever 21, slidably engages groove 23. The free end of lever 21 acts on the lower end of push-rod 11*b*. With pin 24 located between the ends of lever 21, anticlockwise rotation of motor 20 will cause lever 21 to lift sliding member 11 as pin 24 travels in guide groove 23 and clockwise rotation of motor 20 will cause the sliding member 11 to move down.

A coil spring 25 is mounted around push-rod 11*b* such as to urge blocking element 11*a* into an extended position. The two-part construction of sliding member 11 enables blocking element 11*a* to remain stationary in the position shown in FIG. 2 even when lever 21 is lifted by motor 20 at the end of one of the above-mentioned time slots and the safe happens to be open with bar 8 fully engaged in channel 18 and closing off the top end of guide 16 since push-rod 11*b* is able to slide through blocking element 11*a*. And the presence of spring 25, which will have been compressed during the above lifting action of lever 21, enables blocking element 11*a* to be projected into channel 18 immediately after bar 8 has cleared guide 16 when closing the safe, thereby blocking bar 8 in its closed position.

Locking system 1 further comprises four switches 26 to 29 having the following functions:

- switch 26 is positioned beneath guide 16 to detect the presence of sliding member 11 in its lower position;
- switch 27 cooperates with cam 22 to generate a signal in each of the extreme positions of motor 20; thus, when switches 26 and 27 are both closed, sliding member 11 is in its lower position and when switch 26 is open and switch 27 is closed, sliding member 11 is in its upper position (unless temporarily prevented by bar 8);
- switch 28 registers an "attempt to open", i.e. it is actuated by the rear end of bar 8 thereby showing that hand wheel 4 was moved to open the door while sliding member 11 is still in its upper position;
- switch 29 registers that bar 8 is effectively in its withdrawn position (open safe).

FIG. 1 also shows very schematically the principal components of electronic control circuit 13. Keyboard 14 and display means 15 are peripheral units of a microprocessor 30A that cooperates with a RAM/ROM memory 30B. Microprocessor 30A generates by means of a program stored in memory 30B control signals that are issued to motor 20 via an amplifier 31.

The above description provides a summary of the disclosure made in European Patent Application No. 86810154.8 mentioned earlier to which reference should be made to understand how microprocessor 30A works to produce the time schedule for removing the time ban on the opening of locking system 1.

Clearly, if a breakdown occurs to disrupt the normal running of the program and if locking system 1 is closed, and latched by sliding member 11, it would be impossible to enter the protected enclosure except by "violent" breach.

Such a breakdown may, for instance, be due to an operational defect in microprocessor 30A, or to deterioration of the electromechanical or mechanical components in the arrangement shown in FIG. 2.

Figures 3, 5:
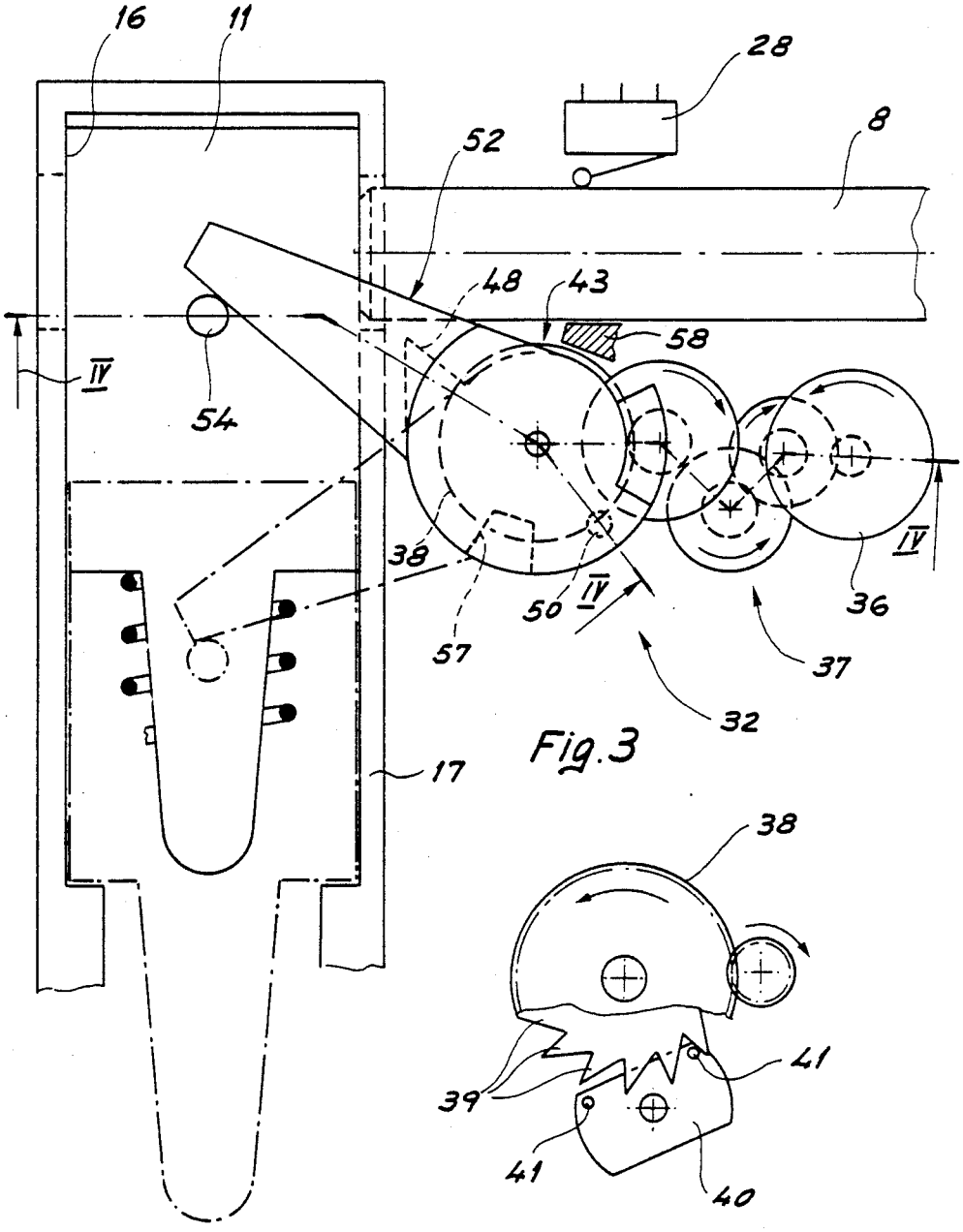
FIG. 3 is a partial, elevational view of the manual emergency unlatching device.
FIG. 5 is a section along line V—V of FIG. 4.

To avoid the problem that would be caused by such a breakdown, an emergency device is provided that will, during the breakdown, enable the ban on the opening of the door caused by sliding member 11 to be lifted. This device, which will now be described in detail with reference to FIGS. 3 to 6, mainly comprises transmission means 32 shown in FIGS. 3 to 5 and a detection and control circuit 33 shown in FIG. 6.

Transmission means 32 are mounted between a pair of plates 34 and 35 solid with support 17 (FIG. 4). An electric drive motor 36 is mounted on plate 34. It is coupled to a reduction train 37 mounted between plates 34 and 35, the last moving part 38 of train 37 being provided with a ratchet wheel 39. The latter cooperates with a pawl or pallet 40 pivotally mounted on plate 35 and comprising a pair of pins 41.

Moving part 38 is rotatably mounted on a first journal 42 of a barrel 43 pivotally mounted in plates 34 and 35.

Barrel 43 is mechanically connected to moving part 38 by a helical spring 44 housed in an annular chamber 45 formed in barrel 43 coaxially of its pivotal axis. Spring 44 is anchored at one end 46 to moving part 38 and at its other end 47 to barrel 43.

Barrel 43 further comprises a beak 48 which is meant to position itself in channel 18 of bar 8 under certain conditions of operation. Beak 48 projects laterally from the body of barrel 43. The latter is also formed with a blind hole 49 having an axis parallel to the axis of rotation of barrel 43 and which opens in the upper end surface of the latter. A coupling dowel-pin 50 is mounted in hole 49 and is outwardly urged by a helical spring 51.

Barrel 43 further comprises a second journal extending from the surface in which opens hole 49. An actuating lever 52, having an arm 53 designed to cooperate with a stud-bolt 54 that is fixed to the side of sliding member 11, is pivotally mounted on this second journal.

A rounded boss 55 on plate 34 normally maintains actuating lever 52 in a rest position by engaging in a recess 56 provided opposite boss 55 in lever 52. The latter is further formed with a notch 57 at the periphery of the part located above barrel 43, notch 57 being intended to cooperate with coupling pin 50.

A stop 58 (FIG. 3) is fitted on plate 34 in order to limit the pivoting angle of barrel 43 when the latter is caused to pivot under the action of spring 44. Stop 58 cooperates with beak 48.

Figure 6:
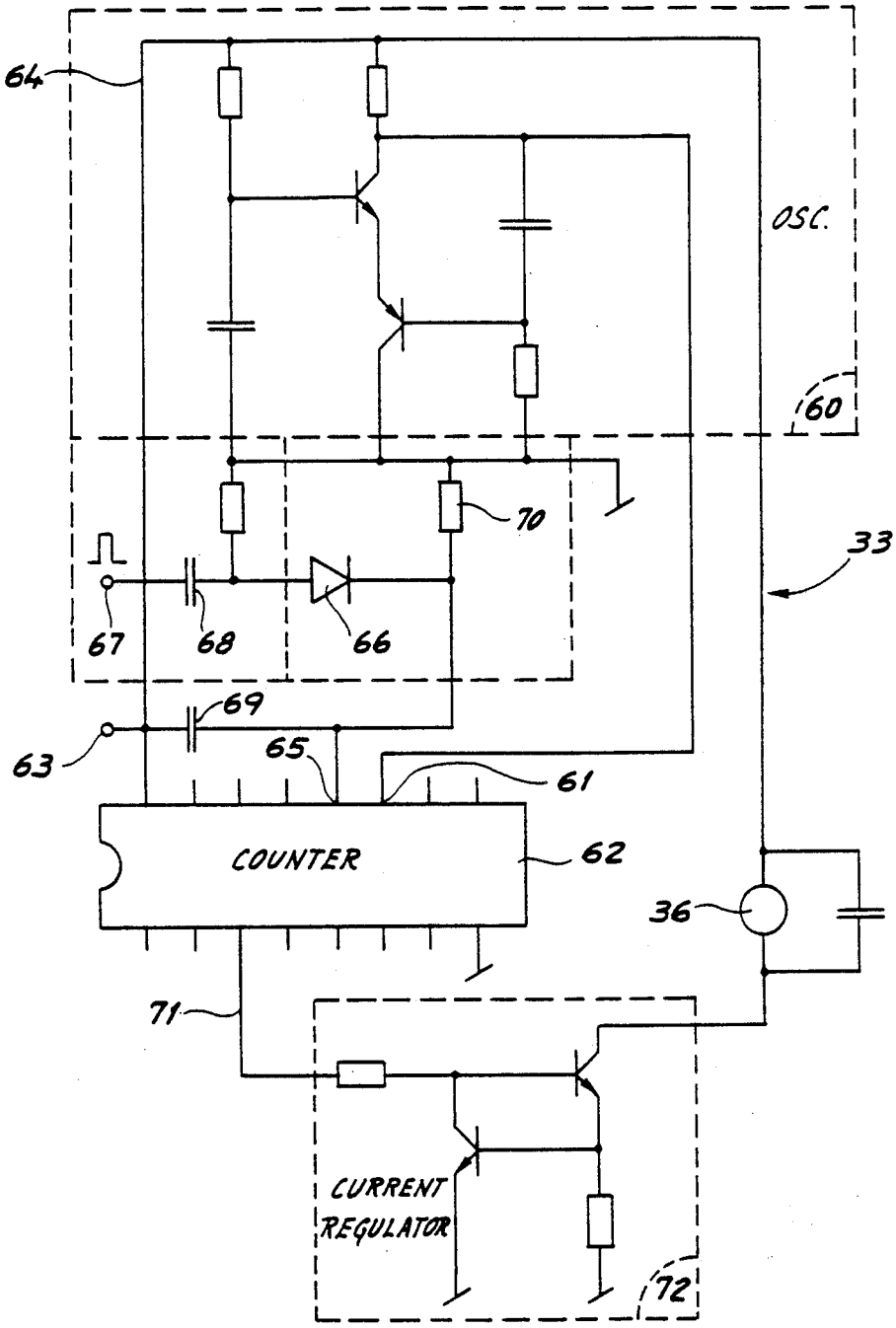
FIG. 6 is a diagram of a circuit for detecting breakdowns and for controlling actuation of the emergency unlatching device.
Figure 7A:
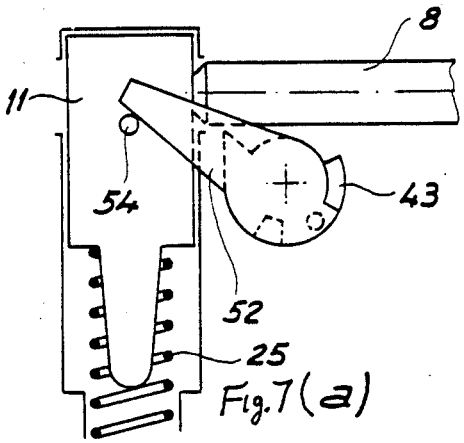
Figure 7B:
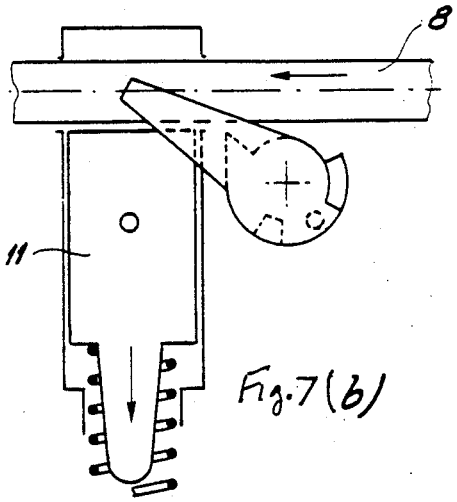
Figure 7C:
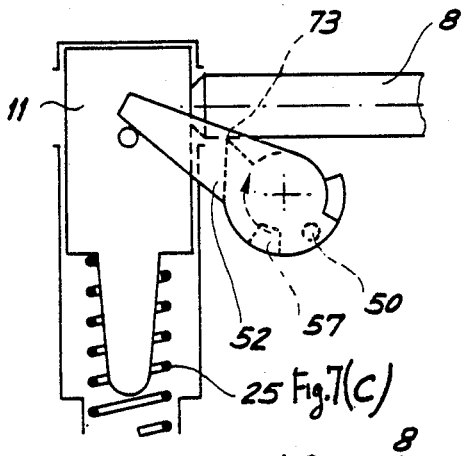
Figure 7D:
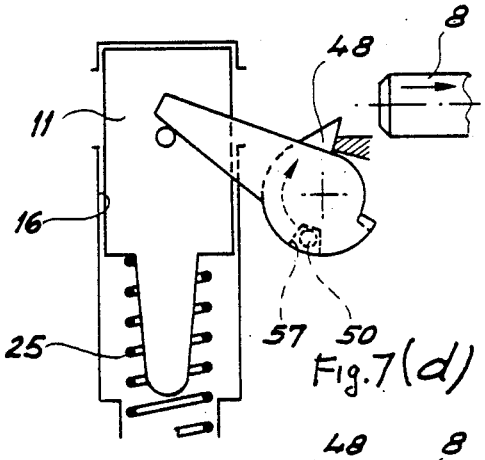
Figure 7E:
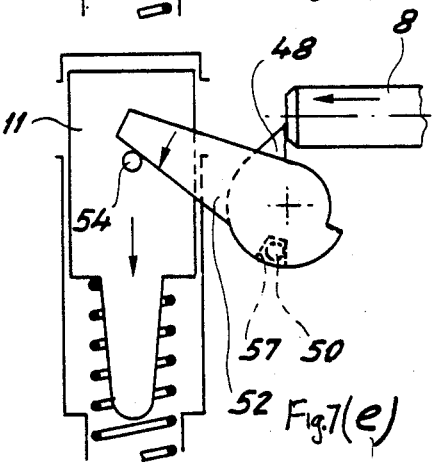
Figure 7F:
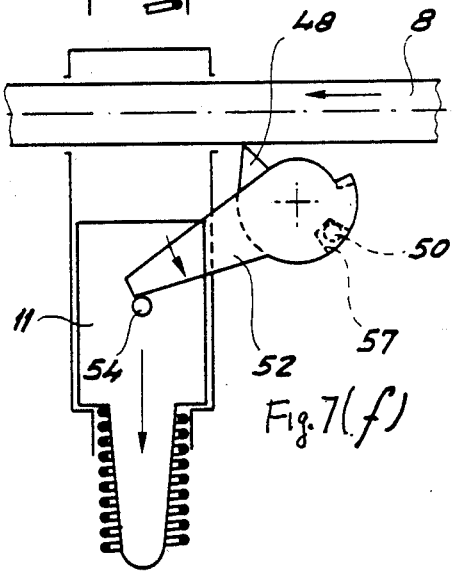

The circuit shown in FIG. 6 comprises an oscillator 60 issuing an output signal having a frequency of e.g. 16 kHz to the counting input 61 of a counter 62. Oscillator 60 is permanently energized off supply terminal 63, via a conductor 64 which is also connected to motor 36. Terminal 63 is moreover connected to the cells that also energize microprocessor 30A, memory 30B, amplifier 31 and motor 20. If however the cells are coming to the end of their life, terminal 63 is then connected to spare cells, preferably of the lithium type. The reset input 65 of counter 62 is connected to a diode 66 connected in turn to an input terminal 67 of the arrangement via a capacitor 68. Input terminal 67 is connected to microprocessor 30A (FIG. 1).

Reset terminal 65 of counter 62 is also linked to the connection between a capacitor 69 and a resistor 70, these components ensuring an initial reset of the counter when a new set of cells is fitted in locking system 1.

An output terminal 71 of counter 62 is connected to a current regulator 72 which is linked to motor 36 to limit its current supply to an acceptable level.

In the example shown, current regulator 72 is activated when terminal 71 generates a pulse of predetermined duration, say two minutes.

Microprocessor 30A periodically issues a monitoring pulse, e.g. every minute, which is applied to the input terminal 67 of the arrangement. Counter 62 is consequently reset every time. If, due to a breakdown, the microprocessor stops issuing monitoring pulses, counter 62 is no longer reset before output terminal 71 generates a pulse. In other words, in the described example, after two minutes, current regulator 72 is activated and motor 36 is energized.

The operation of transmission means 32 will now be described with reference to FIG. 7, bearing in mind that the diagrams are simplified, in particular as regards sliding member 11.

FIGS. *7a* and *7b* show the operational arrangement of transmission means 32 when there is no breakdown, i.e. when the locking system is blocked during an opening ban time slot and unblocked during a time slot when the ban is lifted. These time slots are set in accordance with procedures described in European Patent Application 86810154.8 mentioned earlier.

In FIG. *7a*, sliding member 11 which is maintained in its raised position by lever 21 (FIG. 2) prevents bar 8 from sliding in a direction that will open the door (i.e. to the left in the Figure). But in FIG. *7b*, motor 20 has been actuated by microprocessor 30A, thus enabling sliding member 11 to be lowered to its inoperative position away from channel 18. Bar 8 can then slide freely to the left to open the door after actuation of lock 7 by an authorized person. It should be noted that barrel 43 and lever 52 remain stationary in a well defined relative position in which they are not rotationally solid with one another since dowel-pin 50 bears on the surface of lever 52 that is adjacent barrel 43, away from notch 57.

A breakdown may basically occur in two ways.

First, it may occur in microprocessor 30A. Possibly, because of some damage to its circuit, it gets into a loop, i.e. it continuously performs the same subprogram without being able to re-enter the main program. In such a case, the monitoring pulse which is normally issued every minute and applied to terminal 67 stops, thus activating circuit 33 as described above.

Second, the microprocessor normally receives from switches 26 to 29 an acquittance or confirmation that the operations they are meant to monitor have been duly performed. They may thus for instance indicate to microprocessor 30A that some mechanical part is not in its correct position. This applies to switch 26, which informs microprocessor 30A of the lowered position of sliding member 11. If the downward motion of the latter does not occur, e.g. due to a blockage in guide 16, microprocessor 30A detects the absence of the appropriate signal from switch 26 and its program causes it to interrupt the application of the monitoring pulses to terminal 67.

Either form of breakdown causes bar 8 to be usable to act on sliding member 11 through barrel 43 and lever 52, whatever the position of bar 8 in channel 18 at the time the breakdown occurs, as described below with reference to FIGS. *7c* to *7f*.

In FIG. *7c*, it is assumed that bar 8 has been actuated in an attempt by an operator to open the door. This attempt is detected by the closing of switch 28 (FIG. 3) and is recorded by microprocessor 30A. It is assumed that when the attempt was made, the time slot for lifting the door opening ban had not yet started. Sliding member 11 thus prohibits the opening of the door.

If, under these conditions, microprocessor 30A breaks down, sliding member 11 remains in its raised position even when the time of the attempt coincides with the beginning of a time slot for lifting the ban or otherwise coincides with the time slot.

However, because of its malfunction, microprocessor 30A stops generating monitoring pulses, so that during the maximum period of two minutes following the start of the breakdown, circuit 33 for detecting the breakdown and for controlling actuation of the emergency unlatching device begins to energize motor 36, since counter 62 is able to reach a position at which it generates a pulse on its output terminal 71.

Motor 36 drives gear-train 37, moving part 38 and barrel 43 via spring 44. Consequently, barrel 43 pivots slightly until beak 48 abuts bar 8, as shown at 73 in FIG. *7c*. However, as motor 36 keeps being energized, it tensions spring 44 which accumulates energy as a result of the cooperation between ratchet wheel 39 and pawl 40.

The system then expects some action from the operator.

If, under these conditions, the operator attempts to open the door by turning hand wheel 4 (it is assumed that bolt 6 is lowered), he will find that rod assembly 2 is blocked in spite of the fact that the actual time of making the attempt is within a ban-lifting time slot, since sliding member 11 was not actuated at the required moment by microprocessor 30A. Furthermore, by looking at the outer panel of display means 15, the operator will notice that something abnormal is happening.

He must then move bar 8 back, i.e. rotate hand wheel 4 in a door-locking direction.

In so doing, spring 44, because of the energy it has stored, drives barrel 43 round until beak 48 abuts stop 58. During this pivotal motion, pin 50 comes to register with the notch 57 in lever 52 thereby bringing about an irreversible coupling of the latter with barrel 43 (FIG. *7d*).

If the operator now rotates hand wheel 4 in a door-opening direction, bar 8 then pushes beak 48 out of channel 18 and causes barrel 43 and lever 52, now rotationally solid, to pivot. Lever 52 then forces sliding member 11 downwards to clear channel 18 (FIGS. *7e* and *7f*). By coupling barrel 43 with lever 52, sliding member 11 may be withdrawn from channel 18 by an operator's muscle power. An emergency opening operation is thus independent of the state of the cells energizing the locking system.

No latching by sliding member 11 can now occur again even if bar 8 is moved back again. To return the locking system to normal operation, the cause of the breakdown must be manually fixed and pin 50 manually reset in hole 49.

If the breakdown is caused by a mechanical part of the system, e.g. if sliding member 11 has jammed in guide 16, switches 26 and 27 issue an appropriate signal to microprocessor 30A which, on detecting that this signal does not agree with the program it must execute, cancels the monitoring pulses, thus necessitating the procedure described above.

Should a breakdown occur when the door is either open or locked, the coupling between barrel 43 and lever 52 will still take place since the monitoring pulses will cease being generated, causing motor 36 to be energized and barrel 43 to rotate to stop 58.

The modified construction shown in FIGS. 8 and 9 differs from the form of embodiment described above in that spring 44 is pre-tensioned during assembly of the arrangement, barrel 43 being held by a blocking lever 74 pivotally mounted on a pin 75 in plate 35. One end of lever 74 has a restraining claw 76 which cooperates with a notch 77 in barrel 43. The other end of lever 74 is secured to the core 78 of an electromagnet 79 which is normally not excited and which is energized under the same conditions as motor 36. Apart from these differences, this modified construction operates in the same way as the earlier form of embodiment. The latter arrangement, although technically simpler than the one described previously, is not quite as secure. It might just be possible that the means for lifting the time ban on the opening of the door may accidentally be actuated as by a shock. Such a shock could cause lever 74 and associated core 78 to be tilted, thereby releasing barrel 43 and thus the potential energy stored in pre-tensioned spring 44. In the case of the earlier form of embodiment, the corresponding means cannot be actuated in this way, since spring 44 can only be tensioned in the event of a breakdown.

We claim:

1. For use in a coded and conditional-opening locking system having a locking mechanism, a device for lifting, in the event of a breakdown in the locking system, a time ban on the actuation of said locking mechanism, said locking system comprising an electromagnetic latching unit for blocking the locking mechanism and electronic control means for activating and deactivating the electromagnetic latching unit according to a time-schedule thereby enabling or disabling actuation of the locking mechanism during preset times, wherein said device comprises detection means for sensing a breakdown in said locking system and transmission means controlled by the detection means for making, in response to the detection of a breakdown, said locking mechanism mechanically drive said electromagnetic latching unit such that actuation of said locking mechanism will render said electromagnetic latching unit inoperative regardless of its operative state at the time of detecting the breakdown.

2. A device as claimed in claim 1, wherein said transmission means include:

a first movable part, normally out of the path travelled by said locking mechanism on being actuated and so mounted that it will position itself in this path in the event of a breakdown in the system and, in such an event, be driven by said locking mechanism when the latter is actuated in a direction to open the locking system;

a second movable part able, by its motion, to bring or maintain said electromagnetic latching unit to its inoperative state;

coupling means associated with said first and second movable parts and able to interlock said two parts following a displacement of one with respect to the other; and drive means coupled to said first movable part and connected to said detection means such as to be able to cause, in response to the detection of a breakdown, displacement of said first movable part in order to ensure the interlocking thereof with said second movable part and the positioning thereof in the path travelled by said locking mechanism.

3. A device as claimed in claim 2, wherein said drive means comprise a mechanical energy storage arrangement in order to postpone the interlocking of said movable parts and the positioning of said first movable part in the path of said locking mechanism until the latter comes to occupy for the first time a locking position after detecting a breakdown.

4. A device as claimed in claim 3, wherein said drive means comprise a motor arranged to be energized under the control of said detection means and which is connected to said energy storage arrangement via a transmission thereby to charge said storage arrangement as soon as a breakdown is detected by said detection means.

5. A device as claimed in claim 3, wherein said energy storage arrangement is arranged to be charged during assembly thereof and wherein said drive means comprise a blocking arrangement which normally prevents said first movable part from moving, said blocking arrangement being associated with electromechanical means for releasing the stored energy, said electromechanical means being connected to said detection means to release said first movable part when a breakdown is detected.

6. A device as claimed in claim 2, wherein said movable parts are mounted for pivotal motion around a common axis.

7. A device as claimed in claim 6, wherein said movable parts have radial, contacting surfaces, said coupling means is a pin, said first movable part is formed with a blind hole in which is mounted said pin urged outwards elastically, and said second movable part is formed with a notch which is normally angularly spaced from said pin, said pin being arranged to penetrate into said notch during relative pivoting of said parts in order to produce an irreversible coupling between them.

8. A device as claimed in claim 2, wherein said drive means comprise a mechanical energy storage arrangement in order to postpone the interlocking of said movable parts and the positioning of said first movable part in the path of said locking mechanism until the latter comes to occupy for the first time a locking position after detecting a breakdown, wherein said movable parts are mounted for pivotal motion around a common axis, and wherein said energy storage arrangement is a helical spring mounted in said first movable part coaxially of the pivotal axis of the latter.

* * * * *